US005535893A

United States Patent [19]

Jameson

[11] Patent Number: 5,535,893

[45] Date of Patent: Jul. 16, 1996

[54] METHOD AND APPARATUS FOR SEPARATION BY FLOTATION IN A CENTRIFUGAL FIELD

[75] Inventor: Graeme J. Jameson, New Lambton, Australia

[73] Assignee: University of Newcastle Research Associates Ltd., Australia

[21] Appl. No.: 338,266

[22] Filed: Nov. 10, 1994

Related U.S. Application Data

[63] Continuation of Ser. No. 206,911, Mar. 7, 1994, abandoned, which is a continuation of Ser. No. 90,475, Jul. 12, 1993, abandoned, which is a continuation of Ser. No. 848,991, filed as PCT/AU90/00497, Oct. 18, 1990, published as WO91/05612, May 2, 1991, abandoned.

[30] Foreign Application Priority Data

Oct. 19, 1989 [AU] Australia ..... PJ6942

[51] Int. Cl.[6] ..... B03D 1/24; B03D 1/02; B03B 7/00; B04B 1/06

[52] U.S. Cl. ..... 209/164; 209/169; 209/170; 209/724; 209/451; 209/452; 209/18

[58] Field of Search ..... 209/164, 168, 209/169, 170, 451, 452, 724, 18; 261/122.1; 210/221.2; 494/26

[56] References Cited

U.S. PATENT DOCUMENTS

| | | | |
|---|---|---|---|
| 994,497 | 6/1911 | Berrigan | 209/170 |
| 1,124,854 | 1/1915 | Callow | 209/170 |
| 1,147,633 | 7/1915 | Livingston | 209/168 |
| 1,401,055 | 12/1921 | Dosenbach | 209/170 |
| 1,420,138 | 6/1922 | Peck | 209/170 |
| 1,420,139 | 6/1922 | Peck | 209/170 |
| 1,952,727 | 3/1934 | Ralston | 209/170 |
| 2,054,643 | 9/1936 | Tucker | 209/170 |
| 3,339,730 | 9/1967 | Boutin | 209/170 |
| 3,428,175 | 2/1969 | Hukki | 209/170 |
| 3,810,347 | 5/1974 | Kartinen . | |
| 3,831,767 | 8/1974 | Lefur et al. . | |
| 5,116,487 | 5/1992 | Parekh | 209/170 |

FOREIGN PATENT DOCUMENTS

| | | | |
|---|---|---|---|
| 807996 | 1/1959 | France . | |
| 612919 | 4/1935 | Germany . | |
| 2701305 | 7/1978 | Germany | 209/170 |
| 59-257 | 4/1984 | Japan | 209/170 |
| 371067 | 9/1963 | Switzerland . | |
| 751437 | 7/1980 | U.S.S.R. | 209/170 |
| 15024 | 12/1990 | WIPO | 209/170 |
| 5612 | 5/1991 | WIPO | 209/170 |

*Primary Examiner*—Thomas M. Lithgow
*Attorney, Agent, or Firm*—Ostrolenk, Faber, Gerb & Soffen

[57] ABSTRACT

Method and apparatus for the separation of particles from a particulate suspension. The apparatus comprises a rotating flotation drum (10) with a feed distribution chamber (13). Particulate suspension feed enters the chamber through a delivery pipe (20). The feed passes through holes (21) into the particle collection chamber (22). Air is passed into the particulate suspension through a porous inner wall (29) and a froth is generated. The froth and particulate suspension pass into a froth cleaning chamber (32). The froth is washed by being sprayed from a washwater distribution pipe (47). Froth is removed from the drum by a froth scraper (49) through a froth removal chute (50). Unfrothed particulate suspension passes through openings (40) into a weir chamber (41) and is removed through a launder (45).

18 Claims, 9 Drawing Sheets

METHOD AND APPARATUS FOR SEPARATION BY FLOTATION IN A CENTRIFUGAL FIELD

This is a continuation of application Ser. No. 08/206,911, filed Mar. 7, 1994, now abandoned which is a continuation of application Ser. No. 08,090,475, filed Jul. 12, 1993, now abandoned which is a continuation of application Ser. No. 07/848,991, filed as PCT/AU90/00497, Oct. 18, 1990, published as WO91/05612, May 2, 1991, now abandoned.

TECHNICAL FIELD

This invention relates to flotation apparatus and methods for use in the separation of particles from a particulate suspension. More particularly, the present invention relates to flotation apparatus and methods wherein separation is achieved in a centrifugal field.

BACKGROUND ART

Flotation as currently practised is a process in which one or more specific particulate constituents of a suspension of finely dispersed particles in a liquid become attached to gas bubbles so that they can be separated from other constituents of the slurry. The buoyancy of the bubble-particle aggregate is such that it rises to the surface of the flotation vessel where it is separated from the remaining constituents which remain suspended in the liquid phase.

The success of the flotation process depends crucially on the control of the chemical conditions in the suspension so that the particles which it is desired to float are rendered hydrophobic or non-wetting so that they will attach readily to air bubbles with which they collide in the flotation vessel, while the particles which are not to be floated remain hydrophilic or wetted by the suspension liquid. Chemicals which increase the hydrophobicity of the particles are known as "collectors", and other reagents may also be added, such as "promoters" which tend to improve the performance of the collectors, "depressants" which tend to reduce the hydrophobicity of the "gangue" or material which is not to be floated, and "frothers" which improve the quality of the froth layer formed on the surface of the liquid layer.

In flotation cells in common use, the bubbles are removed from the vessel in the form of a layer of froth or foam on the surface of the suspension liquid. The froth layer overflows into a launder, while the liquid layer is taken from the vessel through an exit pipe in the bottom. The liquid level in the tank is maintained by a suitable control valve acting on the liquid exit stream. The material leaving in the froth, which consists of the hydrophobic particles attached to the bubbles as well as some particulates suspended in the liquid between the bubbles, is known as the "concentrate", while the remaining particulates which leave the vessel in the liquid slurry through the exit port are known as the "tailings".

Two types of flotation equipment are in common use. The older form is the "mechanical cell", in which the slurry is held in a tank which is stirred by a rotating impeller. Air is introduced into the slurry and is broken up into bubbles by the action of the impeller. More recently another form has come into use, in which the feed slurry is introduced to the top of a tower or column, typically 8 to 15 meters in height, and air bubbles are formed in the base of the column, either through a porous medium such as a fabric or rubber sheeting pierced with a large concentration of fine holes; a sintered metal or ceramic material; or a gas liquid mixing device such as a venturi. The bubbles rise up the tall column, colliding with the hydrophobic particles which are descending toward the tails exit pipe in the base of the tower.

In both the mechanical cell and the flotation column, the bubbles form a froth layer on the surface of the underlying slurry, and the material to be floated is removed in the froth. It is a feature of the flotation column, that clean water is introduced to the froth, either by a shower or spray of droplets on the upper surface, or through a piped distribution system immersed in the froth. The purpose of the washing system is to provide a countercurrent flow of clean water which has the effect of flushing the unwanted gangue particles which are normally entrained in the water carried upward in the froth, back into the slurry from which they came. In this way, it is possible to increase the purity of the froth concentrate, relative to the purity which is achievable without froth washing.

In the design of flotation equipment it is advantageous to take steps to effect a rapid contact between the bubbles and the flotable particles, in order to minimize the residence time of the slurry and hence the size of the equipment. In mechanical cells, which are customarily arranged in banks of 2 to 20 machines in series, the overall residence time is typically in the range 5 to 60 minutes, while in column, the residence time is typically 10 to 60 minutes. One way to improve the rate of flotation which has been tried, would be to increase the volumetric flowrate of air passing through the cell or column. This method has been found difficult to put into practise however, for several reasons. In mechanical cells for example, it has been found difficult to design impellers which can disperse large flowrates of gas into fine bubbles. As the air flowrate increase, the "hold-up" or fraction of cell volume occupied by bubbles also increases, and the impeller finds itself rotating not in a liquid but in a gas-liquid mixture. Accordingly, the impeller becomes flooded and cannot impart shear or momentum to the surrounding fluid, and so the sizes of the bubbles formed by the impeller become larger and larger, with increasing flowrate. A similar effect happens with the porous spargers commonly used in flotation columns, although in principle this problem could be overcome by the use of a greater area of sparger surface.

The diameters of bubbles in mechanical and column flotation cells are customarily in the range 0.5 to 3 mm, although when an impeller or sparger is overloaded with air, the diameter can be up to 5 to 10 cm.

Because of practical limitations to do with the distribution of air by rotating impellers or in spargers, the ratio of the air volumetric flowrate to the volumetric flowrate of feed in individual flotation cells or columns is generally in the range of 1 to 4 volumes of air per volume of feed. Increased recoveries could be expected from such cells if the air-feed ratio could be substantially increased without at the same time causing corresponding increases in the amount of entrained gangue.

Another limitation of conventional flotation machines concerns the behaviour of the froth phase, especially in relation to the superficial air velocity $J_G$, which is defined as the volumetric air flowrate (e.g. cubic centimeters per second) divided by the area of cross-section of the cell at right angles to the mean direction of flow of the rising air (e.g. square centimeters).

At low values of the superficial air velocity, a well-defined interface between the froth and the underlying pulp is observed. In such cases liquid is entrained into the froth in the wakes of the bubbles passing through the interface, but the rate of drainage under gravity of the liquid in the thin films between the bubbles just above the interface, is equal to the rate of entrainment of liquid in the bubble's wakes just below the interface, so a stable equilibrium is established. In effect, the void fraction in the froth adjusts itself so that the liquid films between the bubbles are sufficiently large to give the required flow area for the liquid to drain properly. In such cases the position of the interface, i.e. the liquid level, is clear and well-defined and can be sensed by suitable instrumentation, enabling the level to be controlled automatically.

As the superficial air velocity is increased however, the interface between froth and slurry broadens, and it becomes increasingly difficult to distinguish between the phases. The flowrate of entrained material increases as the air velocity increases, but the force under which the froth is draining, i.e. that of gravity, remains the same. For an equilibrium to be established the thickness of the films between the bubbles in the froth has to increase, and eventually, a point is reached when no matter how the void fraction in the froth adjusts itself, it is not possible for the downward draining rate of the liquid to equal the rate of entrainment into the froth phase. When this happens in column flotation, the column is said to be "flooded", and the phenomenon is accompanied by the disappearance of the clear interface between the slurry and the froth and a marked deterioration in performance, occasioned by the flow of massive amounts of entrained material into the froth phase with corresponding reduction in the grade or purity of the concentrate.

Mechanical cells and flotation columns both customarily operate with superficial velocities $J_G$ in the range 0.5 to 3.0 cm/s, and flooding is often observed when $J_G$ exceeds 4 to 5 cm/s. For a given cell of specified area, the possibility of flooding places a practical limit on the allowable air flowrate.

The superficial gas flowrate is important because it is a measure of the amount of gas-liquid interfacial area provided, per unit time. For flotation to occur, it is necessary to capture the hydrophobic particles on a gas-liquid interface, and the greater the interfacial area which is presented to a given volume of liquid, the greater will be the capacity of the interface and hence the flotation cell to remove the flotable material.

It is one of the purposes of the present invention to be able to operate at superficial gas velocities well in excess of 5 cm/s, and therefore to be able to provide much greater interfacial areas for capture and retention of particles than are provided in existing flotation apparatus, relative to the volume of liquid in the equipment at any one time.

Another feature of the invention relates to the ratio of the volume of gas to the volume of liquid with which it is in contact at any given time.

In conventional mechanical and column flotation cells, the contact between bubbles and hydrophobic particles takes place in the slurry phase. Because of the hydrodynamic phenomena associated with two-phase gas-liquid mixtures, the voidage of gas in each form of flotation device is limited to 10 to 20 percent of the total slurry volume. Accordingly, the distances between bubbles is large and the probability of capture of the particles, which are customarily very small in comparison to the bubble size, is correspondingly low. It would be very advantageous to be able to capture the particles in a medium with a much higher void fraction, such as a froth, where the liquid films between the bubbles are very thin, and a particle does not have to travel very far before finding a gas-liquid interface to which it can adhere.

It is therefore a feature of this invention to provide an environment for the capture of flotable particles substantially in a froth phase.

In some flotation applications, for example the removal of oil droplets from waste water, the purity of the product is not important. In such cases, flotation is used as a water cleaning process, and the quantities of material which are floated are only a small proportion of the total feed to the flotation equipment. In mineral processing however, a different problem arises. Often, the valuable mineral is present in the ore as mined in very small amounts, sometimes less than 1 percent by weight. With exsiting technology it is impossible in such cases to separate the values into a high grade product in a single stage, because of the difficulty of reducing the amount of entrained gangue down to the required levels.

Accordingly, the overall flotation operation is carried out in a number of separate steps, known respectively as "roughing", "cleaning" and "scavenging". The finely-crushed ore suspended in water is first subjected to rougher flotation, in which the aim is to remove the values into a low-grade rougher concentrate which is then subjected to one or more further stages of purification by flotation or cleaning, at each stage producing a concentrate of higher and higher grade. Sometimes only one cleaning stage is required, but two or three cleaning stages are common place, and in a few exceptional cases many more than three stages are required. Scavenging is the term used for a further flotation operation applied to the tailings from the rougher stage. The concentration of values in these tailings is usually very low, but to maximise the overall recovery or yield of valuable material, the tails are subjected to one more flotation operation in the scavengers in order to capture any final traces. The scavenger concentrate is usually returned to the feed to the roughers, although it may also pass direct to the cleaners.

It would obviously be advantageous to be able to carry out all of these flotation operations in the one piece of equipment, but with existing technology this has not been possible because of the long residence times required to capture the values and the slow drainage of entrained gangue from the froth.

It is therefore an aim of one embodiment of the present invention to be able to carry out the operations of roughing, cleaning and scavenging in the one flotation apparatus.

The froth from conventional flotation machines whether of the mechanical or the column variety, discharges in the form of a voluminous aerated stream, often containing less than 10 percent by volume of liquid, the remainder being the flotation gas. It is necessary before further processing, to collapse the froth into a slurry of particles in water, and this froth-breaking step may require a considerable residence time. It would be advantageous to be able to produce a concentrate directly in the form of a liquid rather than as a froth, and it is an aim of one embodiment of the invention to break the froth within the machine and produce a concentrate in liquid form.

In many cases, it is desired to make a product from which the water has been substantially removed. It is the aim of one realisation of the present invention, to be able to make a product in a semi-dry form.

DISCLOSURE OF INVENTION

Accordingly in one aspect the invention may broadly be said to consist in apparatus for the separation of particles from a particulate suspension, comprising a drum having a cylindrical wall and an axis, support and drive means arranged to support and rotate the drum about its axis, feed means arranged to feed particles in suspension into one end of the drum adjacent the cylindrical wall, gas supply means arranged to introduce gas into the drum through the cylindrical wall, a stationary froth scraper positioned within the drum and arranged to remove froth from a desired location within the drum, and one or more circular baffles or weirs protruding inwardly from the cylindrical wall and arranged to control the flow of liquid and/or froth axially along the drum.

In a further aspect the invention may broadly be said to consist in a method of separating particles from a particulate suspension comprising the steps of:

introducing the particulate suspension into one end of a cylindrical drum rotating about its axis, at a position adjacent the cylindrical wall of the drum;

introducing a gas into the drum through the cylindrical wall causing a froth to form on at least the radially inward surface of the suspension;

controlling the axial flow of the particulate suspension and/or froth along the drum by one or more circular baffles or weirs protruding inwardly from the cylindrical wall; and removing froth from the radially inward surface thereof at a location remote from the said one end.

The invention further provides apparatus for the separation of particles from a particulate suspension, comprising a drum having a cylindrical wall and an axis, support and drive means arranged to support and rotate the drum about its axis, feed means arranged to feed particles and suspension into one end of the drum adjacent the cylindrical wall, a stationary froth scraper positioned within the drum and arranged to remove froth from a desired location within the drum, and one or more circular baffles or weirs protruding inwardly from the cylindrical wall arranged to control the flow of liquid and/or froth axially along the drum.

The invention also provides a method of separating particles from a particulate suspension comprising the steps of:

introducing a supersaturated particulate suspension into one end of a cylindrical drum, rotating about its axis, at a position adjacent the cylindrical wall of the drum;

controlling the axial flow of the particulate suspension and/or froth along the drum by one or more circular baffles or weirs protruding inwardly from the cylindrical wall; and removing froth from the radially inward surface thereof at a location remote from the said one end.

Preferably the drum incorporates a first zone in communication with the feed means, wherein the feed means is arranged to feed the particulate suspension into the first zone adjacent the cylindrical wall, and furthermore wherein the first zone is defined by the drum cylindrical wall and a baffle plate attached to the drum axis and perpendicular to the axis.

In a preferred form the drum further incorporates a second and third zone, the second zone adjacent to and in communication with the first zone, the third zone adjacent to and in communication with the second zone and gas supply means arranged to independently distribute gas through the second and third zones respectively. It is preferred that the gas is distributed through a perforated inner cylindrical sleeve, the sleeve defined by the drum cylindrical wall, and a perforated inner cylindrical wall parallel to and coaxial with the drum cylindrical wall. It is also preferred that froth washing means is provided in the third zone.

In another aspect of the present invention, a weir chamber is located adjacent to and in communication with the unfrothed suspension exiting from the drum adjacent the perforated inner cylindrical wall in the third zone.

A preferred mode of operating the apparatus of the present invention is where the internal diameter of the third zone is greater than the internal diameter of the second zone. Furthermore, the stationary froth scraper can be located internally and adjacent to the exit of the drum and scrapes only the generated froth.

In another preferred form of the present invention, the apparatus comprises a froth-breaking beach in the form of a hollow cylinder concentric with the drum and attached to the exit end of the drum, and is in communication with the stationary froth scraper. The froth-breaking beach may comprise a flared lip at its end and this lip may be disposed within a cylindrical launder which has a discharge pipe at its lowest extremity.

The apparatus may further comprise a fourth zone, adjacent to and communicating with a third zone, and located between the third zone and the weir chamber. In such a preferred form, a secondary froth scraper is provided adjacent to the exit of the drum in the fourth zone, said secondary froth scraper feeding froth back into the froth entering the second zone. An annular damming baffle may also be provided which extends from the perforated inner cylindrical wall of the drum and partially into the drum, and which is perpendicular to the drum axis and is located in the third zone of the drum. Suspension ducts may also extend from the damming baffle communicating with the fourth zone and provided around the circumference of the damming baffle such that they are located adjacent to the perforated inner cylindrical wall.

Furthermore, an annular baffle extending from the drum cylindrical wall, partially into the drum, and perpendicular to the drum axis, may be provided which separates the third zone from the fourth zone.

In another preferred embodiment of the present invention, the apparatus comprises a froth chute which transfers froth entering the third zone adjacent to the annular damming baffle, to a region between the annular damming baffle and the annular baffle between the third and fourth zone. Apparatus may be provided where the weir chamber comprises a chute for direct removal of suspension from the weir chamber. The weir chamber may be fitted with a scraper which scrapes the internal cylindrical base of the weir chamber.

In a preferred mode of the present invention, the drum further comprises a cylindrical extension member at its exit end, coaxial with the drum, the cylindrical extension member comprising an internal cylindrical mesh adjacent to its cylindrical wall, a series of interconnected mesh scraper knives, said mesh scraper knives disposed so as to scrape the mesh and an exit chute disposed so as to receive mesh scrapings, wherein the stationary froth scraper discharges froth directly on to the screen.

In a preferred form, the feed means may be a pipe communicating with and directed towards the lowest internal drum cylindrical wall. Also the washing means may be a pipe sealed at one end and pierced with a series of nozzles, which nozzles are confined and directed in the third zone of the drum. Furthermore, in a preferred form the froth scraper, secondary froth scraper and chutes are pipes, with the froth collecting end being an opening directed towards the oncoming rotation of froth.

In a preferred operational mode, the particulate suspension is introduced into a first zone of the cylindrical drum at a position adjacent the cylindrical wall of the drum, and passes from the first zone into a second zone, wherein a gas is introduced into the particulate suspension through a perforated internal cylindrical wall of the drum to form a froth, froth is transferred to a third zone in which it is subjected to a further gasification, is washed and is removed from the exit end of the drum. Preferably the froth is washed by the spraying of a liquid on its radially innermost surface. Preferably the froth is removed adjacent the exit end of the drum via a froth scraper.

In a preferred operational mode, the gas flowrate to the second zone is regulated differentially to the gas flowrate to the third zone. The present invention also preferably provides a method wherein unfrothed suspension is removed at the exit end of the drum at the periphery of the perforated internal cylindrical wall. The unfrothed suspension may be passed into a weir chamber and subsequently recovered.

In another preferred aspect of the operational mode of the present invention, froth and the particulate suspension are passed into a fourth zone, adjacent the third zone, and gas is introduced into the fourth zone through a further perforated cylindrical wall and froth is scraped from the fourth zone and returned to the second zone. It is preferable that the froth is scraped from a region adjacent the entrance to the third zone, and is passed into a region defined by an annular damming baffle located in the third zone and a baffle located between the third zone and the fourth zone. It is also desirable that unfrothed suspension is transferred via a chute from the weir chamber adjacent the exit of the drum for removal. The weir chamber may be scraped so as to prevent the deposition on any of the weir chamber surfaces of unfrothed suspension.

Desirably the froth exiting from the drum is transferred onto a mesh, and the mesh is enshrouded by a cylindrical extension member attached to the drum end, wherein the unfrothed suspension drains through the mesh, is returned to the drum, and particles remaining on the mesh are scraped from the mesh and retrieved.

In a further preferred operational mode of the present invention, the particulate suspension is supersaturated with a gas prior to introducing the particulate suspension into the drum. Preferably the gas is the same gas as is introduced through the drum cylindrical wall. Desirably supersaturation is achieved by pressurising the particulate suspension in the presence of a gas.

The invention is described principally with reference to air as the gaseous flotation medium, and particles of mineral which it is desired to separate suspended in a slurry of water. However, the application of the invention is not limited to these systems, and in fact it would be efficacious in any gas-liquid system where a separation or a selective separation can be effected by making use of the fact that particles which are non-wetting can be made to attach themselves to bubbles or a gas-liquid interface and can be carried into a froth phase and thereby removed from the initial suspension in liquid or slurry.

The present invention relates to flotation apparatus and methods in which the flotation is carried out substantially in the froth phase in a centrifugal field. The particles to be separated by flotation are introduced in a suspension or slurry to a flotation vessel mounted for rotation about a generally horizontally oriented axis. The vessel is in the form of a generally cylindrical drum whose inner surface includes a porous wall through which air can be blown into the slurry. The feed enters at one end of the drum and is brought up to the speed of rotation of the drum before contacting the porous wall. The slurry is flung outward against the porous wall by centrifugal force acting on all elements of the suspension, and air is blown through the porous wall at such a velocity that the liquid suspension is immediately aerated and transformed into a froth. The froth is acted on by the centrifugal acceleration which is much larger than that of gravity, so the bubbles being less dense than the liquid, are forced inward toward the axis of the cylinder while the liquid tends to be forced away from the axis.

In the absence of a centrifugal field, if air is blown through a porous wall into an overlying layer of liquid, for example in a vessel whose entire base consists of a porous fabric or pierced rubber sparger, it is observed that individual bubbles are initially formed which rise into the liquid, and in the presence of frother form a supernatant froth or foam. As the air rate is increased, the bubble size increases markedly and the liquid tends to be lifted away by very large bubbles from the porous wall so that a layer of air is sandwiched between the liquid and the porous wall.

Surprisingly it has been found that when bubbles are blown into a liquid in a centrifugal field of sufficient magnitude, created for example in a cylindrical drum rotating about its axis, the diameters of the bubbles formed remain small, of order 0.5 to 2 mm, and a stable froth layer is created which extends radially inwardly, virtually from the surface of the porous wall. Accordingly, a very favourable environment is created for the rapid collection of hydrophobic particles from the slurry, in that it is possible to operate with superficial air velocities much in excess of those in use in current flotation technology, and flotation occurs almost entirely in a froth phase of high void fraction and high interfacial area.

BRIEF DESCRIPTION OF THE DRAWINGS

Preferred embodiments of the invention will now be described, by way of example only, with reference to the accompanying drawings in which.

MODES FOR CARRYING OUT THE INVENTION

Figure 1:
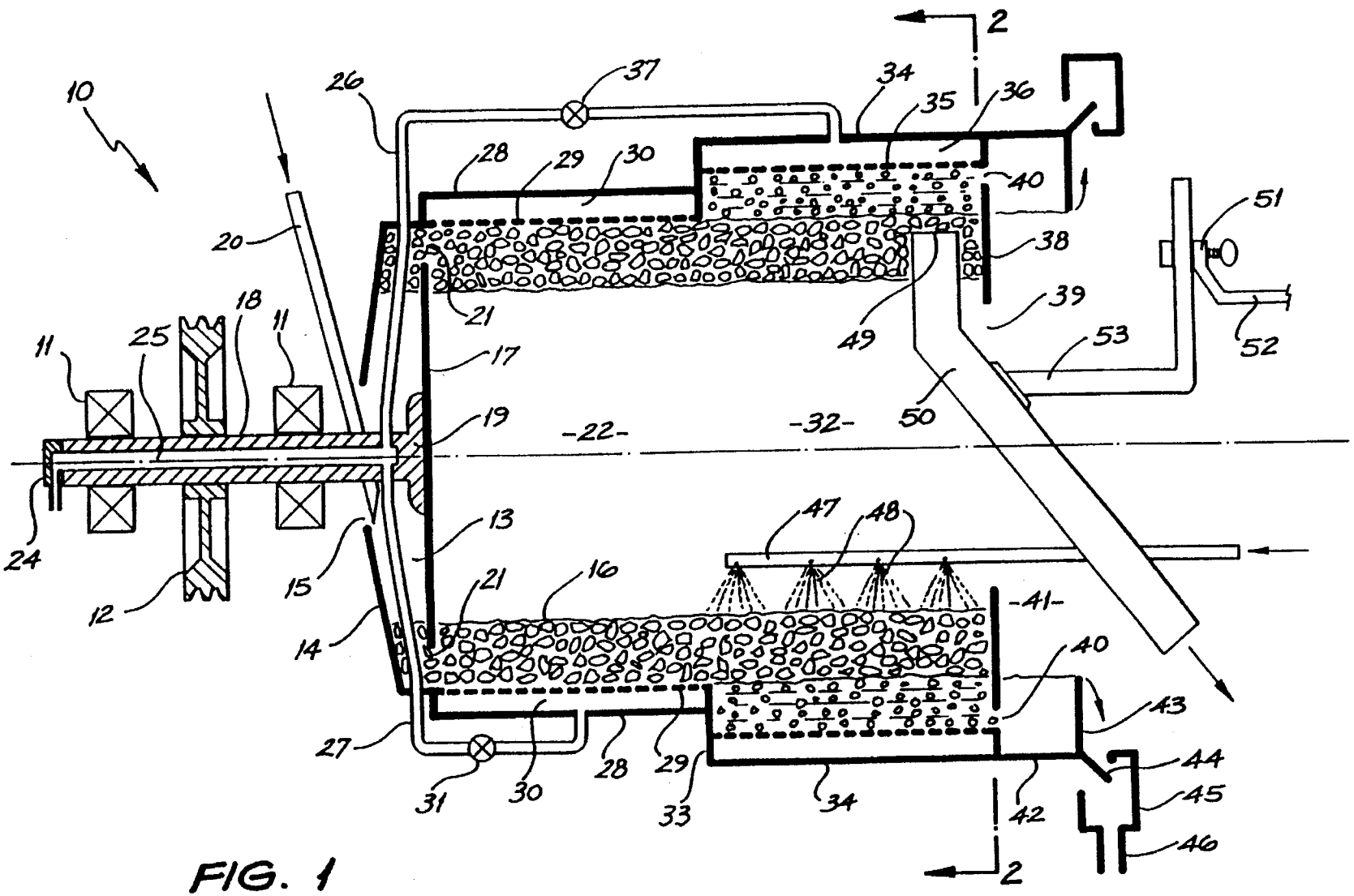
FIG. 1 shows a vertical longitudinal section through the apparatus of the present invention.
Figure 2:
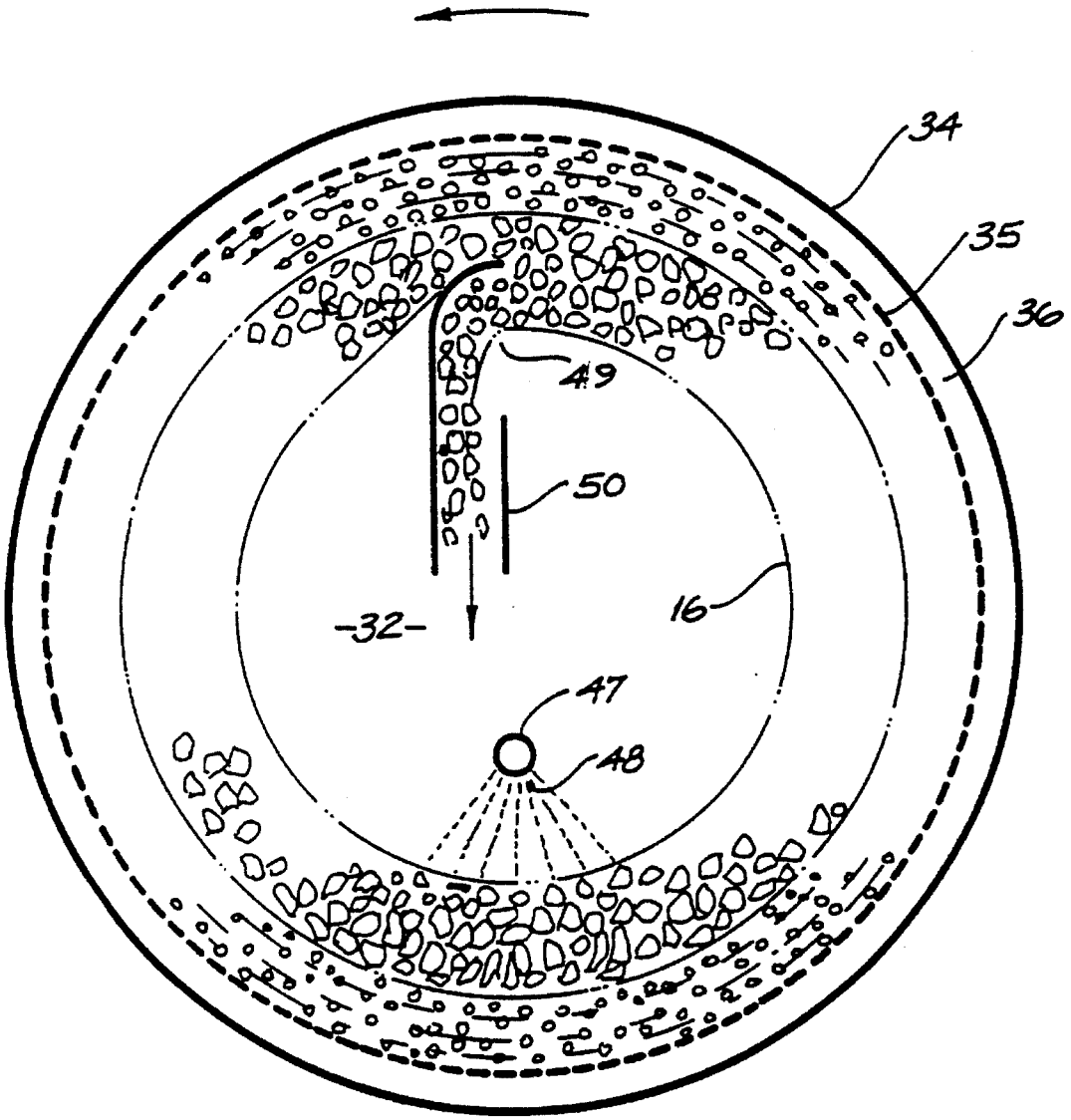
FIG. 2 shows an end view in the plane 2—2 of FIG. 1.

Referring to FIGS. 1 and 2, the flotation apparatus generally designated 10 is mounted in bearings 11 so that it can rotate in a generally horizontal plane, being driven through the pulley 12. The flotation drum 10 has a first or feed distribution chamber 13 formed between a concentric and conical end plate 14 whose mouth 15 has a minimum internal diameter which is less than the diameter of the cylindrical inner surface 16 of the froth in the flotation drum 10, and a concentric driving plate 17 to which is attached the drive shaft 18 by a boss or hub 19. Feed enters through a delivery pipe 20 and is brought up to the speed of rotation of the drum in the first chamber before passing through holes or entries 21 into the second or particle collection chamber 22.

An air inlet in the form of a rotating union 24 is fitted to the end of the shaft 18 which contains a passage 25 which leads to two distribution pipes 26 and 27 which pass through the cylindrical outer walls of the first chamber, the wall openings being suitably sealed to prevent loss of the feed liquid.

The second or particle collection chamber 22 is in the form of a cylindrical drum with an impervious outer wall 28 lined with a porous inner wall 29 which is coaxial and parallel to the outer wall, enclosing an annular plenum or air distribution chamber 30 to which is connected the air feed pipe 27, fitted with a control valve 31.

The second or particle collection chamber 22 is connected to a third or froth cleaning chamber 32 by a concentric flange 33 whose inner diameter is approximately the same as the inner diameter of the cylindrical porous wall 29. The outer wall 34 of the third chamber is impervious to gas flow and is lined with a coaxial and parallel porous wall 35, enclosing a plenum 36 connected to the air feed pipe 26 through the control valve 37. The third or froth cleaning chamber 32 is enclosed by the concentric end plate 38, the diameter of whose central opening 39 is less than the minimum desired diameter of the cylindrical inner surface of the froth layer 16, so that the froth contents of the cell are thereby retained. The concentric end plate 38 has openings 40 to allow drainage of liquid into the tailings discharge runner or weir chamber 41, which has a cylindrical outer wall 42 and a concentric overflow weir 43. The inner diameter of the concentric annular overflow weir 43 is chosen to be approximately the same as the inner diameter of the cylindrical porous wall 29 of the second or particle collection chamber. Attached to the outer periphery of the overflow weir 43 is a concentric flared lip 44 which rotates within a stationary tails launder 45 fitted at its lowest extremity with a tails discharge pipe 46.

A washwater distribution pipe 47 carries spray nozzles or holes 48 at desired intervals along its length and is located substantially within the third or froth washing chamber 32.

A froth scraper 49 is mounted on the end of a froth removal chute 50, with its opening facing toward the oncoming froth. The scraper and chute assembly is held on an arm 53 located in place by the adjustable clamp 51 and stand 52.

If necessary, longitudinal, radial or helical baffles (not shown) may be installed to guide the froth and/or the liquid phases as they move axially along the rotating drum.

Figure 4:
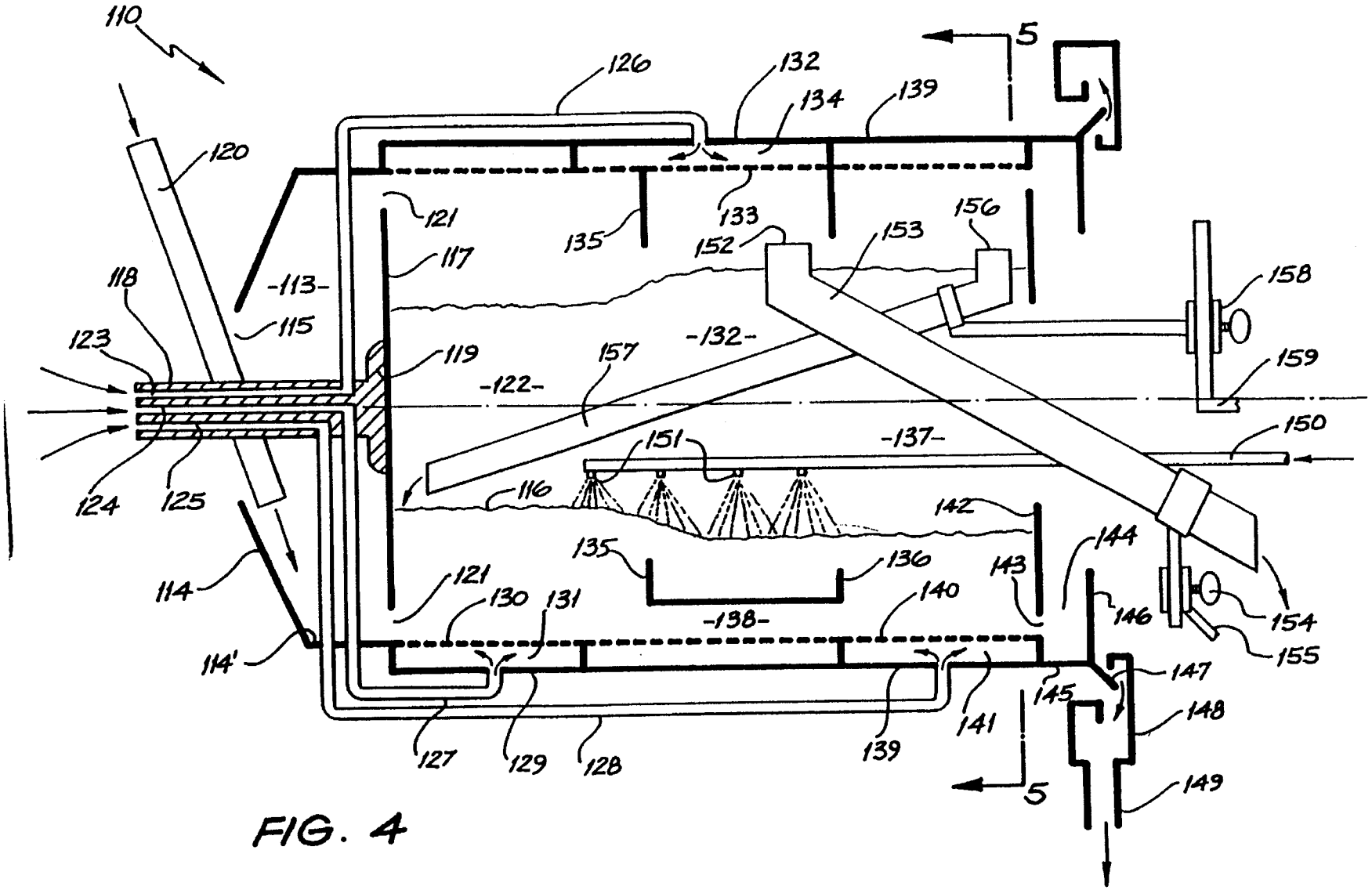
FIG. 4 shows an extended version of the apparatus of the present invention in a vertical longitudinal section through the apparatus.

In FIG. 4 the flotation apparatus is mounted so that it can rotate in a generally horizontal plane. The flotation drum 110 has a first or feed distribution chamber 113 formed between a concentric and conical end plate 114 whose mouth 115 has a minimum internal diameter which is less than the diameter of the cylindrical inner surface 116 of the froth in the flotation drum 110, and a concentric driving plate 117 to which is attached the drive shaft 118 by a boss 119. Feed enters through the delivery pipe 120 and is brought up to the speed of rotation of the drum in the first or feed chamber before passing through holes or entries 121 into the second or roughing chamber 122.

Air enters through internal passages 123, 124 and 125 in the shaft 118, leading respectively to the distribution pipes 126, 127 and 128 which pass through sealed openings in the cylindrical outer walls of the first chamber 113. The air rates through the various entry pipes are separately controllable by a valve system not shown.

The second or roughing chamber 122 is in the form of a cylindrical drum with an impervious outer wall 129 lined with a porous inner wall 130 which is coaxial and parallel to the outer wall, enclosing between them an annular plenum or air distribution chamber 131 connected to the air supply by the pipe 127. Connected to the second or roughing chamber 122 is a third or cleaning chamber 132 whose inner diameter is approximately the same as the inner diameter of the cylindrical porous wall 130. The outer wall 132 of the third or cleaning chamber is lined with a coaxial and aprallel porous wall 133 enclosing a plenum 134 connected to the air supply by the pipe 126. Part way along the cleaning chamber is an annular dam wall 135 and at the end of the said chamber is an annular dividing wall 136, both walls being concentric. The dividing wall 136 separates the third or cleaning chamber from the fourth or scavenging chamber 137. At intervals around the circumference of the third or cleaning chamber are communicating bypass ducts 138 which connect the entry region of the third chamber with the fourth chamber. The ducts are conveniently hemispherical or rectangular in section, with the outer wall being formed by the porous wall 133.

The outer wall 139 of the fourth or scavenging chamber 137 is cylindrical and of essentially the same diameter as that of the outer walls of the first, second and third chambers. It is lined with a coaxial and parallel porous wall 140 enclosing a plenum 141 connected to the air supply by the pipe 128. The fourth or scavenging chamber 137 is enclosed by the concentric end plate 142, the diameter of whose central opening 143 is less than the minimum desired diameter of the cylindrical inner surface of the froth layer 116. The concentric end plate 142 has openings 143 to allow drainage of liquid into the tailings discharge runner or weir chamber 144, which has a concentric cylindrical outer wall 145 and a concentric overflow weir 146. The inner diameter of the overflow weir 146 is chosen to be approximately the same as the inner diameter of the dividing wall 136. Attached to the outer periphery of the overflow weir 146 is a concentric flared lip 147 which rotates within a stationary tails launder 148 fitted at its lowest extremity with a tails discharge pipe 149.

A washwater distribution pipe 150 carries spray nozzles or holes 151 at desired intervals along its length directed primarily within the third or cleaning chamber 132.

A froth scraper 152 with its opening facing into the direction of rotation of the drum 110, is mounted on the end of a froth removal chute 153, toward the exit end of the third or cleaning chamber 132. The scraper and chute assembly is held in place by the adjustable clamp 154 and stand 155. The chute is directed through the mouth of the end plate 143 and out of the drum 110.

A second froth scraper 156 is mounted with its opening facing into the direction of rotation of the drum 110, is mounted on the end of a froth recirculation chute 157, toward the end of the fourth or scavenging chamber 137. The chute is directed through the whole of the third or cleaning chamber 132 and debouches at the entrance of the second or roughing chamber 122. The scraper 156 and chute 157 assembly is held in place by an adjustable clamp 158 and stand 159.

Figure 6:
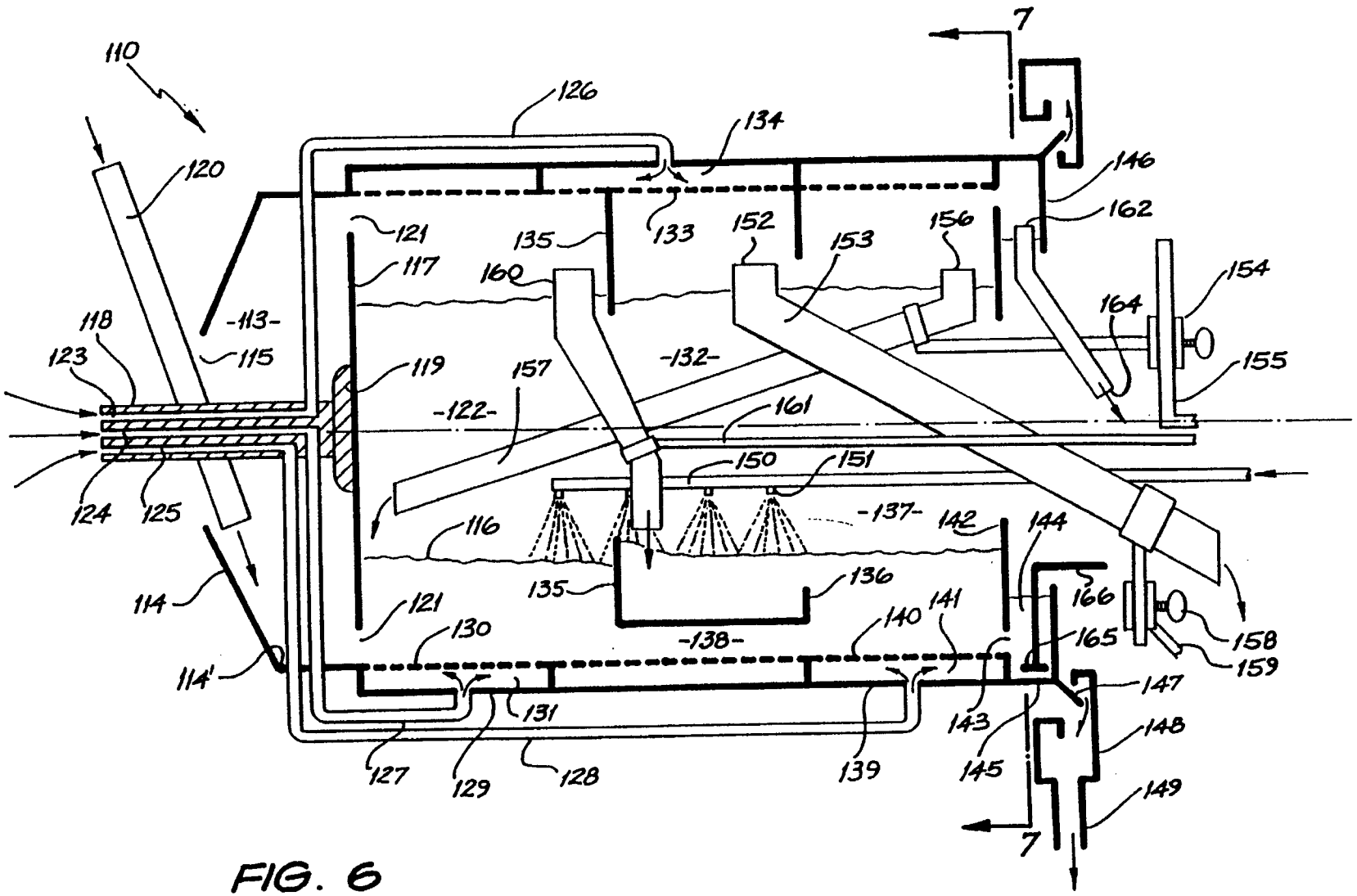
FIG. 6 shows a further embodiment of the apparatus of the present invention in a vertical longitudinal section through the apparatus.

In the alternative embodiment shown in FIG. 6 a chute 160 is mounted on an arm 161 which is held in place by a suitable adjusting clamp and stand not shown so that the position of the chute may be adjusted. The chute has an opening which faces substantially into the direction of rotation of the drum, and the exit from the chute is directed toward the froth cleaning chamber 132 between the dividing walls 135 and 136.

The operation of the flotation equipment is now described with reference to the Figures. The flotation drum is normally set in motion at a constant speed of rotation so as to produce a centrifugal acceleration in the range 3 to 100 times that of gravity, 'g'. The feed is conditioned as required so as to make the particles which it is desired to remove by flotation suitably hydrophobic or non-wetting by the liquid while leaving the gangue or material which is not to be floated in the wettable state, and may contain other reagents such as conditoners, frothers and activators as appropriate.

In the realisation depicted in FIGS. 1 and 2, the feed enters through the feed pipe 20. In flowing over the surface of the end wall 14 of the first or feed chamber the feed liquid is accelerated to the rotational speed of the drum 10 and passes through the entry passages 21 in the end plate 17, to enter the second or particle collection chamber 22. Here the liquid feed encounters a high flux of air bubbles generated at the surface of the porous inner wall 29, and is immediately aerated to form a froth bed. Under the action of the centrifugal field established by the rotation about the axis of the cylindrical drum, the bubbles formed at the surface of the porous wall break off very quickly while still small, of order 0.5 to 2 mm in diameter, and entrain the liquid feed away from the wall and into the froth. In the froth layer, the void fraction is high, of order 60 to 90 percent, and the liquid exists in the thin liquid films between the bubbles. The hydrophobic particles attach to the gas-liquid interfaces and are swept to the inner surface 16 of the froth layer, being swept away from the feed entrances 21 by the incoming new feed and air streams.

The axial length of the second chamber 22 is proportionate to the rate of entry of feed liquid and the nature of the flotable particles, so that by the time the froth leaves the second chamber 22 and passes into the third or froth cleaning chamber 32, all the hydrophobic particles have essentially attached to gas-liquid interfaces.

On entering the third chamber 32, the froth is irrigated with washwater from the entry pipe 47 and the distribution means 48. (Washwater is not essential to the operation of the apparatus, but in many cases its use is advantageous in that the water tends to wash entrained gangue material from the froth and back into the liquid phase which constitutes the tailings stream). The liquid in the froth drains through it under the action of the centrifugal field, while the flotable particles remain attached to the surfaces of the bubbles in the froth. The operation of the froth cleaning chamber 32 is assisted by having control of the air flow through the porous wall 35 separate and relative to the air flow through the porous wall of the second or collection chamber 22. This control can be through adjustment of the air flow regulation valves 31 and 37, or by providing porous walls of differing permeabilities. It is generally advantageous to arrange matters so that the superficial air velocity normal to the porous wall in the froth washing chamber 32 is less than that in the collection chamber 22, so that the froth can drain as it moves toward the exit of the drum.

In the invention, the processes of particle collection, by which is meant the attachment of the hydrophobic particles to the surfaces of bubbles, are carried out separately and independently from the processes of froth drainage. In this way, the environment necessary for the optimum performance of the separate processes can be achieved by, for example, the adjustment of the separate air rates in the collection chamber 22 and the froth cleaning chamber 32, the use of the washwater and the adjustment of the froth removal scraper 49.

The froth containing the flotable particles is removed by the froth scraper 49 whose position can be adjusted by raising or lowering within the clamp 51 which is held in a fixed position relative to the axis of the drum by the stand 52.

The moveable froth scraper 49 is a useful improvement over known centrifugal flotation equipment in that it enables the position of the point of removal of the froth from the drum to be varied, and hence gives an independent control on the froth quality on removal. By lightly skimming the surface of the froth, for example, a well-drained froth of high grade (very little entrained gangue) will be removed, while if the scraper is moved further into the froth layer, it will remove a larger quantity of froth but the grade will not be so high.

Note that the internal diameters of the second and third chambers 22 and 32 may be the same, or may with advantage be constructed so that the internal diameter of the third chamber is greater than that of the second chamber, so as to provide a larger area perpendicular to the direction of flow, to permit the liquid to drain from the froth particularly under the action of the washwater introduced through the sprays 48 and the pipe 47, and flow toward the tails exit openings 40.

The liquid which drains from the froth collects near the wall of the washing chamber 32, and flows out of the openings 40 into the weir chamber 41, from which it overflows and, under the action of the centrifugal field, is flung outwardly over the flared lip 44 and into the tailings launder 45, from which it flows under gravity into the tailings discharge pipe 46. The internal diameter of the weir chamber end plate 43 in effect controls the liquid level in the drum and should be sized accordingly.

Figure 3:
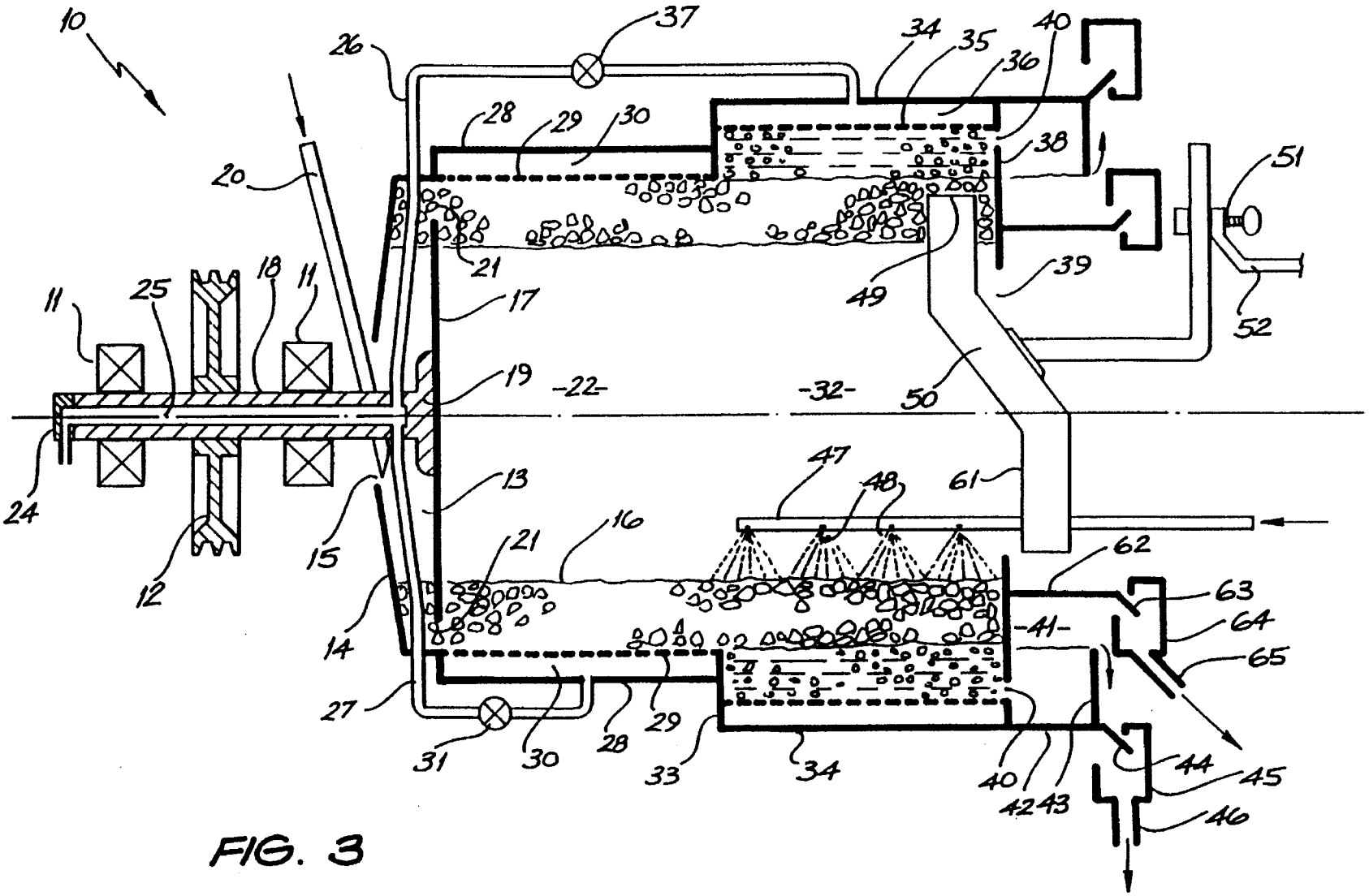
FIG. 3 shows a further embodiment of the present invention in a vertical longitudinal section through the apparatus.

One of the problems associated with the handling of the froth concentrate after it has left a flotation cell is that the froth does not flow easily under the action of gravity, and it is often found in practice that the froth will back up in discharge launders unless kept flowing by water sprays. It is well known that if a froth is subjected to a centrifugal force it will drain readily and in effect collapse into a liquid form. The present apparatus provides a ready means to break the froth through the use of centrifugal force, subsequent to its removal by the scraper 49 and chute 50, as shown in FIG. 3.

In this alternative, the froth chute 50 is directed by the angled end piece 61 toward a froth-breaking beach 62 which is in the form of a hollow concentric cylinder attached to the end plate 38, and bearing at its outer end a concentric flared lip 63. The lip is enclosed within a stationary concentrate launder 64 which has at its lowest extremity a concentrate discharge pipe 65.

In operation, the froth which is collected by the scraper 49 and the stationary chute 50 falls under gravity on to the rotating froth-breaker 62 where it accelerates to the rotational speed of the flotation drum and under the action of the centrifugal force, collapses into a substantially liquid form to flow over the concentrate lip 63 into the stationary launder 64 and out through the concentrate discharge pipe 65.

Figure 3A:
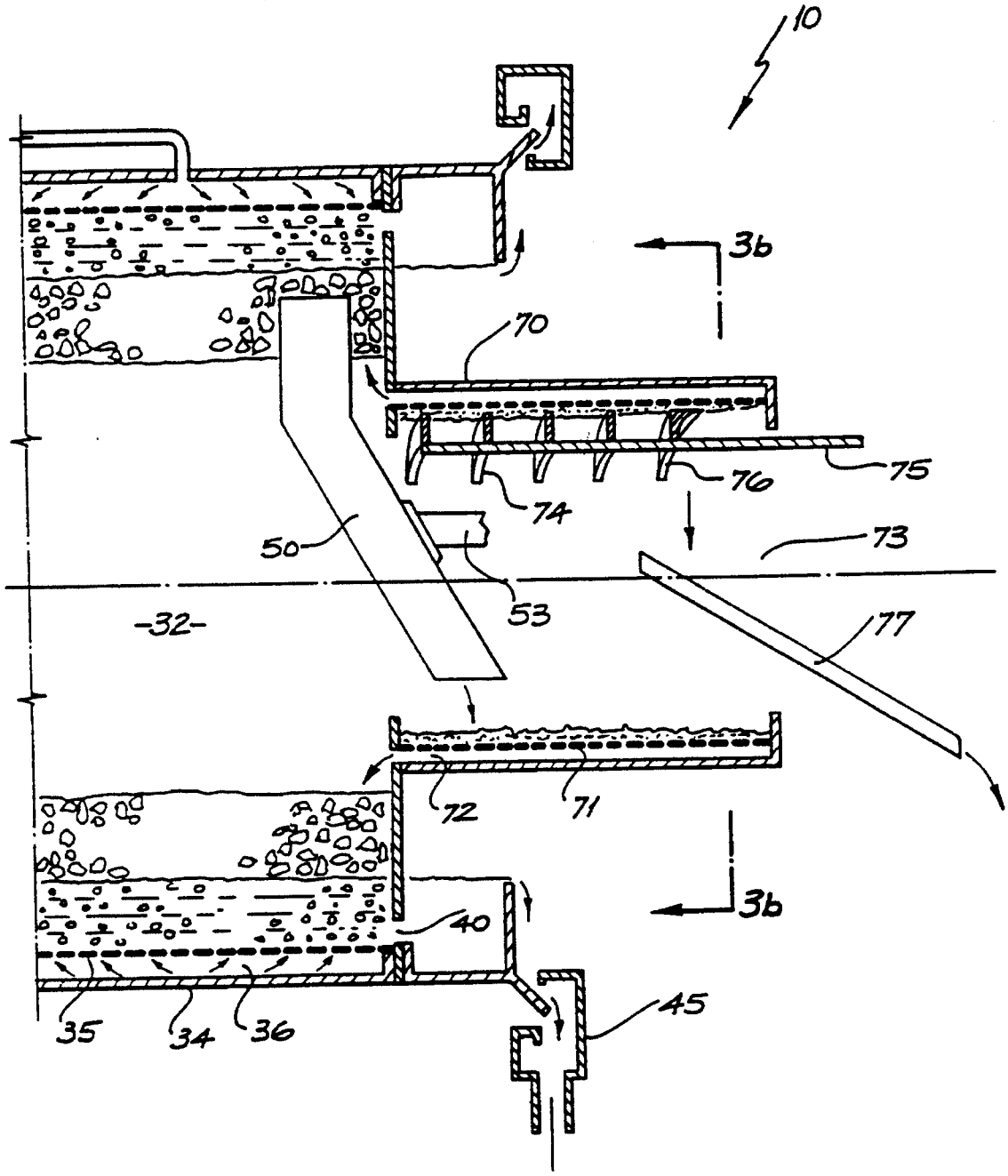
FIG. 3*a* details apparatus for treatment of froth exiting from the drum.
Figure 3B:
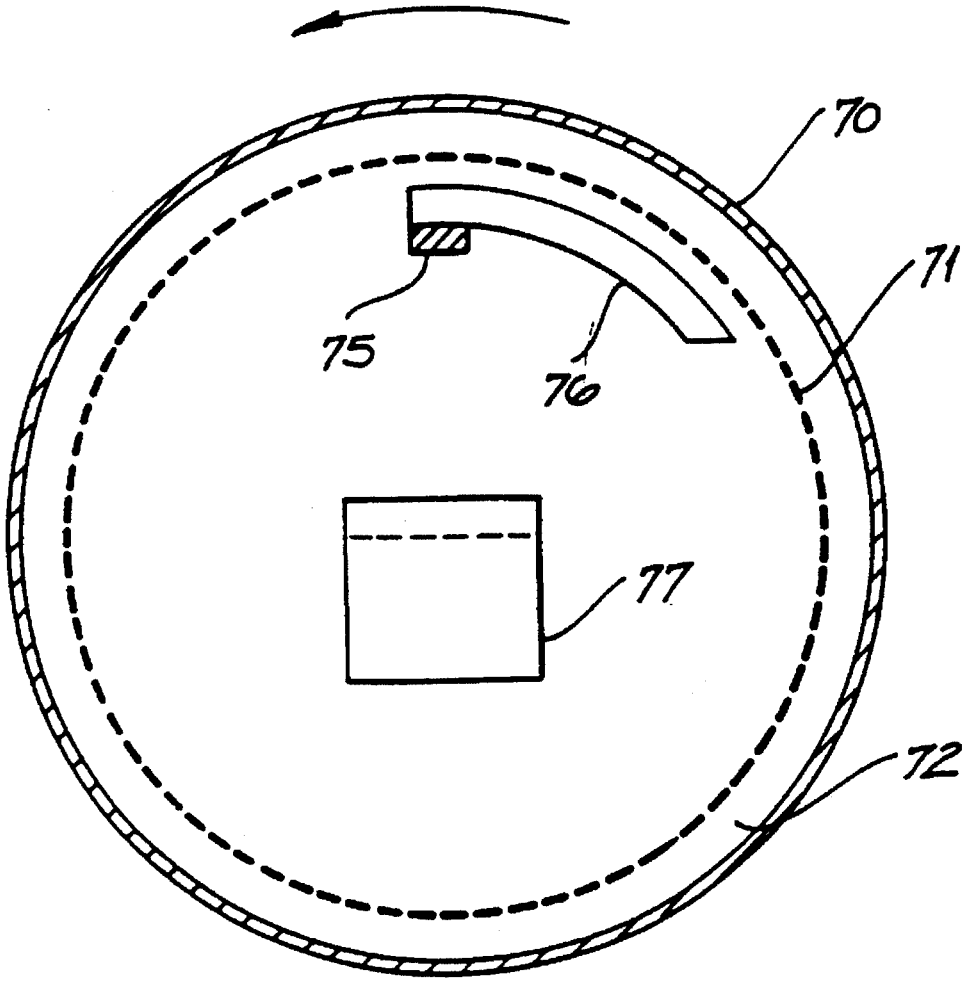
FIG. 3*b* shows an end view in the plane 3*b*—3*b* of FIG. 3*a;*

A further advantage can be obtained with the modification shown in FIG. 3*a*, which consists of an essentially cylindrical extension to the main equipment 10, which replaces the beach 62. The outer wall of the extension 70 is impermeable, and it is lined with a fine mesh or screen 71. Froth produced in the chamber 32 is removed by the scraper 49 and chute 50, and is directed to fall on to the screen 71. Initially the froth is quite mobile, and it quickly spreads and breaks to form a slurry of the floated particles in the froth liquid. The liquid drains through the screen 71 under the action of the centrifugal forces and flows back into the chamber 32 through the opening 72. The solids which remain on the screen are moved gradually towards the exit 73 of the drum 70, through the action of a series of scrapers or knives 74 mounted on an arm 75 whose position may be varied so that the knives may be moved in a generally radial direction, either closer to or further away from the rotating screen, as required. The knives are in the form of a segment of an annular ring as shown in FIG. 3*b*, which is a sectional view on the plane 1—1 of FIG. 3 and are inclined to the plane which is perpendicular in all directions to the axis of rotation, in such a way that as the drum rotates, the solids which are deposited on the screen are moved by a small distance in each rotation, towards the exit 73. The final knife 76 is conveniently made in the form of a ploughshare, so that a strong inwardly-directed radial motion is imparted to the solids from which at this point the liquid has mainly been removed. Thus the solids fall onto the chute 77 and are removed from the apparatus as the substantially dry concentrate.

Figure 5:
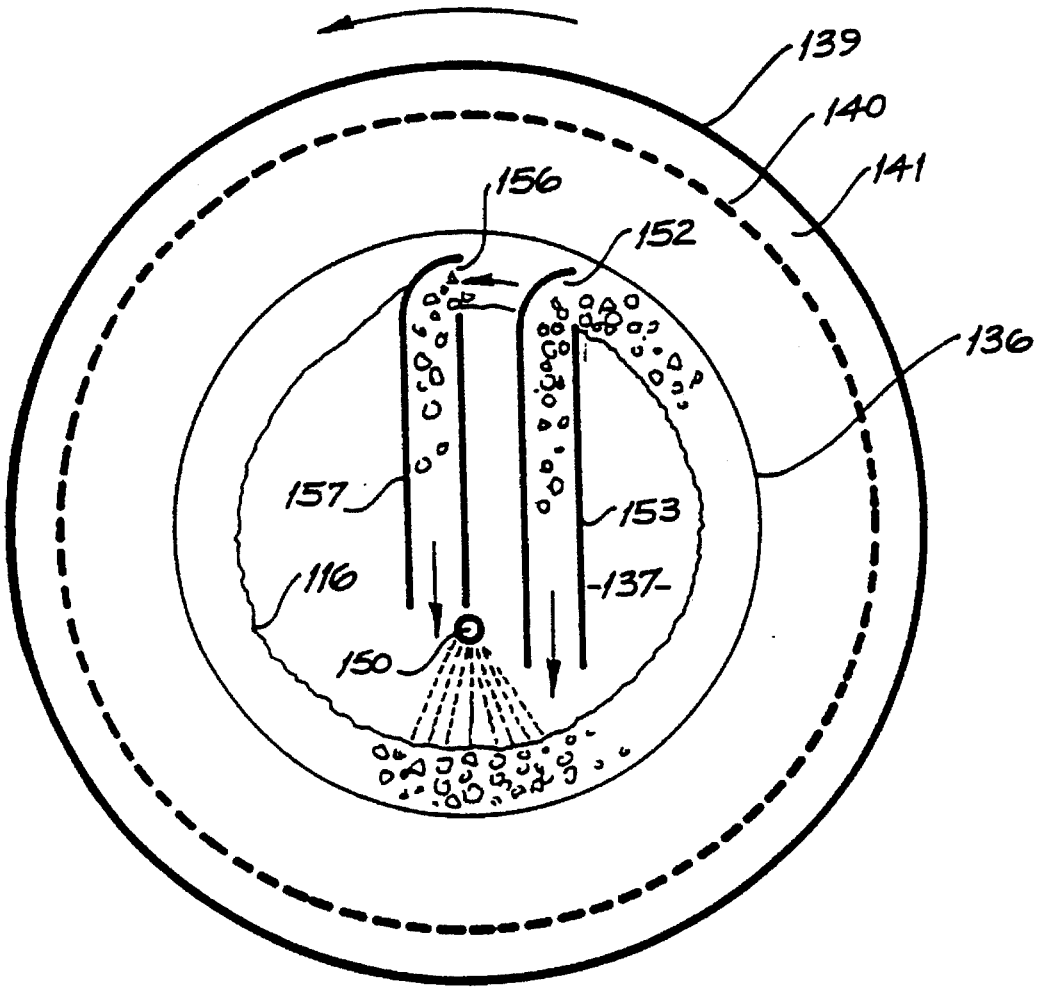
FIG. 5 is an end view of the cross-section on the plane 5—5 of FIG. 4.

The realisation depicted in FIGS. 4 and 5 is intended to achieve the steps of roughing, cleaning and scavenging in the one stage. The drum is rotating so as to produce a centrifugal acceleration of 3 to 100 times that of gravity. The properly conditioned feed enters the first or feed chamber 113 through the feed pipe 120, and is brought up to the same rotational speed as the drum by contact with the end plate 114 and the chamber wall 114'. It then passes through the entry passages 121 to enter the second or roughing chamber 122. Here it encounters a high flux of air bubbles generated at the surface of the porous wall 130, and is immediately aerated to form a froth bed. Under the action of the centrifugal field established by the rotation of the cylindrical drum about its axis, the bubbles formed at the surface of the porous wall break off very quickly while still small, of order 0.5 to 2 mm in diameter, and entrain the liquid feed away from the wall and into the froth. The high void fraction in the froth phase leads to rapid collection of the hydrophobic particles on the surfaces of the bubbles.

The froth is displaced away from the inlet by the incoming feed and air, and moves into the third or cleaning chamber 132. The superficial velocity of the air passing through the porous wall 136 of the cleaning chamber is controlled to be less than that in the roughing chamber, and the froth begins to drain, with the liquid being replaced by clean washwater from the spray bar 150. Liquid is restrained by the weir 135, and passes through the communicating ducts 138 into the fourth or scavenging chamber, while the froth flows over the weir 135 and continues into the remainder of the cleaning chamber, where it continues to undergo drainage and cleaning by the washwater. Near the end of the cleaning chamber, the cleaned concentrate is removed by the froth scraper 152 and flows out of the flotation drum through the duct 153.

The liquid and froth from the cleaning chamber, from which the valuable particles have substantially been removed, flows over the weir 136 into the fourth or scavenging chamber 137, into which the liquid underflow from the roughing chamber also flows through the ducts 138. Air is enabled to flow into these ducts through the porous wall 136 in order to prevent particles from settling out from the liquid while in transit through them, under the action of the centrifugal force. In the scavenging chamber, further air is introduced through the porous wall 140, and any remaining valuable particles are captured on the bubbles and returned to the beginning of the rougher chamber 122 by means of the scraper 156 and chute 157. The scraper and chute assembly is held by the clamp 158 and the stand 159, so that the position of the scraper can be varied as appropriate.

The liquid which drains in the scavenging chamber passes out through the openings 143 in the end wall 142 into the tailings runner 144, and thence over the tailings weir 146 and over the flared lip 147 into the tailings launder 148, leaving finally through the exit pipe 149.

The centrifugal liquid-removal drum 70 shown in FIG. 3*a* can be used with advantage to treat the froth concentrate from any of the realisations shown in FIGS. 1, 4 and 6.

Figure 7:
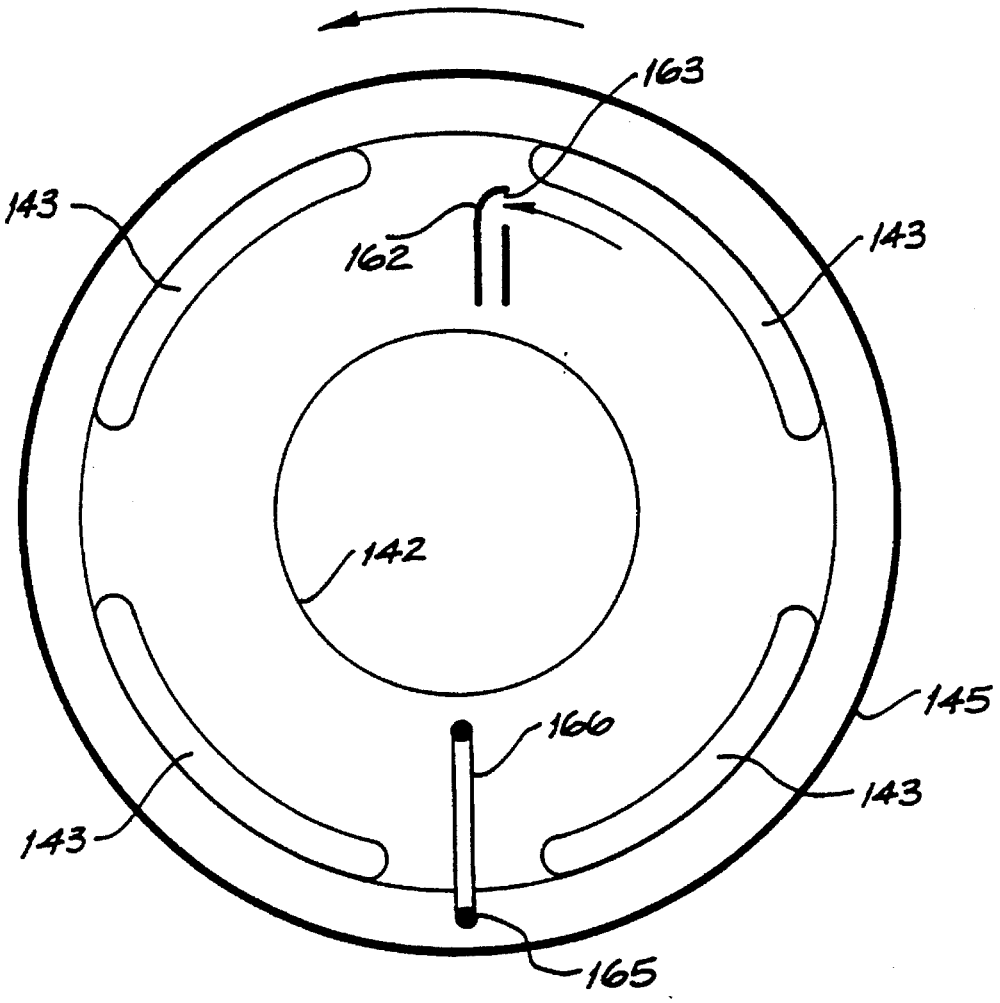
FIG. 7 is an end view through the plane 7—7 of FIG. 6.

It is advantageous in some circumstances to install a chute for the removal of the tailings from the weir chamber 144, in the same manner as is shown for the withdrawal of the froth. The chute 162 in FIG. 6 and FIG. 7 is held on a mounting so that its position in the radial direction can be varied so as to increase or decrease the effective depth of tailings liquid in the runner 144. The opening of the chute faces toward the oncoming tailings, which accordingly enter the chute through the opening 163 and discharge from the equipment through the opening 164.

It is possible that under the action of the centrifugal force there will be a tendency for particles to migrate outwardly to settle on the inner face of the wall 145 of the fourth or weir chamber 144. This is not normally a problem since the centrifugal acceleration although large compared with that of gravity 'g', being in the range 3 g to 100 g, it is actually small compared with the centrifugal forces which have been found to be necessary for substantial migration of particles in industrial centrifugal equipment in which the centrifugal acceleration is customarily in excess of 550 g. However, if desired a small stationary scraper 165 as shown in FIGS. 6 and 7 may be used to agitate the liquid in the tailings runner 144 and to overcome any tendency for particles to settle under the action of the centrifugal field. The agitation blade is mounted on an adjustable arm 166 so that is position relative to the wall can be varied as appropriate.

The invention is described with reference to a feed liquid which is commonly water containing a suspension of mineral, oil or other material which can be rendered non-wetting so that it will adhere to a gas-liquid interface. In mineral flotation as normally practised, contact is made between bubbles and particles, by forcing them to collide due to local velocity differences in the liquid; or by trapping them in the thin liquid films within a foam, where the film thickness may be of the same order as the particle size. A third way of creating a bubble-particle aggregate, is to grow the bubble on the surface of the particle, by deposition from a supersaturated solution of gas in the liquid. This method is particularly suitable for very small particles, of order 1 μm or less, which have so little inertia that the probability of capture by collision is very small. These particles can act as nucleation sites for bubble growth and hence the bubble forms where it is needed. However, such bubbles are normally very small in themselves, of order 20 to 100 μm in diameter, and their rise velocity in water is very small, so that a considerable residence time is required in the flotation cell to allow these small bubbles to rise to the surface into the froth layer.

It is advantageous if such a suspension of very fine particles is released as the feed into an apparatus forming the present invention, supersaturated for example with air at a pressure of 100 to 600 kPa above the operating pressure in the apparatus. When the pressure is released, small bubbles immediately begin to form. In the presence of the centrifugal field, the rise velocity of these small bubbles carrying the particles on which they have nucleated, is enhanced. Hence the time needed to remove them from the liquid is much reduced. Also, in the presence of the air supplied through the porous walls 29 of the flotation machine, a favourable environment is created for the small bubbles grown from solution to be captured by coalescence with the much larger bubbles (0.5 to 2 mm diameter) which are formed at the wall, further enhancing the rate of removal of the finest bubbles.

It is therefore a purpose of the present invention, to treat feed liquids which have been supersaturated with a sparingly soluble gas such as air at a pressure 100 to 600 kPa above the ambient pressure in the apparatus, in order to improve the efficiency of removal of the bubbles generated when the pressure is reduced, and hence increase the rate at which flotable material can be separated from the liquid.

I claim:

1. Apparatus for the separation of particles from a liquid particulate suspension, comprising a substantially horizontal drum having a cylindrical wall and an axis, support and drive means arranged to support and rotate the drum about its axis, feed means arranged to feed liquid particulate suspension into one end of the drum adjacent the cylindrical wall, another end of the drum being an exit end, gas supply means arranged to introduce gas into the drum through the cylindrical wall so as to cause a froth to form on the liquid, a stationary froth scraper positioned within the drum and arranged to remove froth from a desired location within the drum, and one or more circular baffles or weirs protruding inwardly from the cylindrical wall at locations intermediate the length of the cylindrical wall of the drum so as to divide the drum axially into at least two zones and arranged to control the flow of liquid and/or froth axially along the drum from zone to zone.

2. The apparatus of claim 1 wherein the drum incorporates a first zone in communication with the feed means, the feed means arranged to feed the particulate suspension into the first zone adjacent the cylindrical wall.

3. The apparatus of claim 2 wherein the first zone is defined by the drum cylindrical wall and a baffle plate attached to the drum axis and perpendicular to the axis.

4. The apparatus of claim 2 wherein the drum further incorporates a second and third zone, the second zone adjacent to and in communication with the first zone, the third zone adjacent to and in communication with the second zone and gas supply means arranged to independently distribute gas through the second and third zones respectively.

5. The apparatus of claim 4 wherein the gas is distributed through a perforated inner cylindrical sleeve, the sleeve defined by the drum cylindrical wall, and a perforated inner cylindrical wall parallel to and coaxial with the drum cylindrical wall.

6. The apparatus of claim 4 wherein froth washing means is provided in the third zone.

7. The apparatus of claim 5 wherein a weir chamber is located adjacent to and in communication with the suspension exiting from the drum adjacent the perforated inner cylindrical wall in the third zone.

8. Apparatus as defined in claim 4 wherein the stationary froth scraper is located internally and adjacent to the exit end of the drum, and scrapes only the generated froth.

9. Apparatus as defined in claim 4 comprising a froth-breaking beach in the form of a hollow cylinder concentric with the drum and attached to the exit end of the drum, and in communication with the stationary froth scraper.

10. Apparatus as defined in claim 4 further comprising a fourth zone, adjacent to and communicating with a third zone, and located between the third,zone and a weir chamber.

11. Apparatus for the separation of particles from a liquid particulate suspension, comprising a drum having a cylindrical wall and an axis, support and drive means arranged to support and rotate the drum about its axis, feed means arranged to feed liquid particulate suspension into one end of the drum adjacent the cylindrical wall, another end of the drum being an exit end, gas supply means arranged to introduce gas into the drum through the cylindrical wall so as to cause a froth to form on the liquid, a stationary froth scraper positioned within the drum and arranged to remove froth from a desired location within the drum, and one or more circular baffles or weirs protruding inwardly from the cylindrical wall at locations intermediate the length of the cylindrical wall of the drum so as to divide the drum axially into at least two zones and arranged to control the flow of liquid and/or froth axially along the drum from zone to zone;

wherein the drum incorporates a first zone in communication with the feed means, the feed means arranged to feed the particulate suspension into the first zone adjacent the cylindrical wall, a second zone adjacent to and in communication with the first zone, and a third zone adjacent to and in communication with the second zone and gas supply means arranged to independently distribute gas through the second and third zones respectively;

wherein the internal diameter of the third zone is greater than the internal diameter of the second zone.

12. Apparatus for the separation of particles from a liquid particulate suspension, comprising a drum having a cylindrical wall and an axis, support and drive means arranged to support and rotate the drum about its axis, feed means arranged to feed liquid particulate suspension into one end of the drum adjacent the cylindrical wall, another end of the drum being an exit end, gas supply means arranged to introduce gas into the drum through the cylindrical wall so as to cause a froth to form on the liquid, a stationary froth scraper positioned within the drum and arranged to remove froth from a desired location within the drum, and one or more circular baffles or weirs protruding inwardly from the cylindrical wall at locations intermediate the length of the cylindrical wall of the drum so as to divide the drum axially into at least two zones and arranged to control the flow of liquid and/or froth axially along the drum from zone to zone;

wherein the drum incorporates a first zone in communication with the feed means, the feed means arranged to feed the particulate suspension into the first zone adjacent the cylindrical wall, a second zone adjacent to and in communication with the first zone, a third zone adjacent to and in communication with the second zone and gas supply means arranged to independently distribute gas through the second and third zones respectively, and a fourth zone, adjacent to and communicating with the third zone, and located between the third zone and the weir chamber;

wherein a secondary froth scraper is provided adjacent to the exit end of the drum in the fourth zone, said secondary froth scraper feeding froth back into the froth entering the second zone.

13. Apparatus for the separation of particles from a particulate suspension, comprising a drum having a cylindrical wall and an axis, support and drive means arranged to support and rotate the drum about its axis, feed means arranged to feed particles and suspension into one end of the drum adjacent the cylindrical wall, gas supply means arranged to introduce gas into the drum through the cylindrical wall, a stationary froth scraper positioned within the drum and arranged to remove froth from a desired location within the drum, and one or more circular baffles or weirs protruding inwardly from the cylindrical wall and arranged to control the flow of liquid and/or froth axially along the drum;

wherein the drum further comprises a cylindrical extension member at its exit end, coaxial with the drum, the cylindrical extension member comprising an internal cylindrical mesh adjacent to its cylindrical wall, a series of interconnected mesh scraper knives, said mesh scraper knives disposed so as to scrape the mesh and an exit chute disposed so as to receive mesh scrapings, wherein the stationary froth scraper discharges froth directly onto the cylindrical mesh.

14. A method of separating particles from a particulate suspension comprising the steps of:

introducing the particulate suspension into one end of a substantially horizontal rotating cylindrical drum, at a position adjacent the cylindrical wall of the drum;

introducing a gas into the drum through the cylindrical wall causing a froth to form on at least the radially inward surface of the suspension;

controlling the axial flow of the particulate suspension and/or froth along the drum by one or more circular baffles or weirs protruding inwardly from the cylindrical wall at locations intermediate the length of the cylindrical wall of the drum so as to divide the drum axially into at least two zones; and removing froth from the radially inward surface thereof at a location remote from the said one end.

15. The method of claim 14 wherein the particulate suspension is introduced into a first zone of the cylindrical drum at a position adjacent the cylindrical wall of the drum, and passes from the first zone into a second zone, wherein a gas is introduced into the particulate suspension through a perforated internal cylindrical wall of the drum, to form a froth, the froth is transferred to a third zone in which it is subjected to a further gasification, is subjected to spray water wash and is removed from the exit end of the drum.

16. The method of claim 15 wherein the gas flow rate to the second zone is regulated differentially to the gas flow rate to the third zone.

17. The method as defined in claim 14 wherein the particulate suspension is supersaturated with a gas prior to introducing the particulate suspension into the drum.

18. A method of separating particles from a particulate suspension comprising the steps of:

introducing the particulate suspension into one end of a rotating cylindrical drum, at a position adjacent the cylindrical wall of the drum;

introducing a gas into the drum through the cylindrical wall causing a froth to form on at least the radially inward surface of the suspension;

controlling the axial flow of the particulate suspension and/or froth along the drum by one or more circular baffles or weirs protruding inwardly from the cylindrical wall cylindrical wall at locations intermediate the length of the cylindrical wall of the drum so as to divide the drum axially into at least two zones and arranged to control the flow of; and removing froth from the radially inward surface thereof at a location remote from the said one end;

wherein the particulate suspension is introduced into a first zone of the cylindrical drum at a position adjacent the cylindrical wall of the drum, and passes from the first zone into a second zone, wherein a gas is introduced into the particulate suspension through a perforated internal cylindrical wall of the drum, to form a froth, the froth is transferred to a third zone in which it is subjected to a further gasification, is subjected to spray water wash and is removed from the exit end of the drum; and wherein froth and the particulate suspension pass into a fourth zone, adjacent the third zone, gas is introduced into the fourth zone through a further perforated cylindrical wall and froth is scraped from the fourth zone and returned to the second zone.

* * * * *